US008570703B2

(12) United States Patent
Jendrejack et al.

(10) Patent No.: US 8,570,703 B2
(45) Date of Patent: Oct. 29, 2013

(54) APPARATUS AND METHODS FOR MODIFICATION OF ELECTROSTATIC CHARGE ON A MOVING WEB

(75) Inventors: Richard M. Jendrejack, Hudson, WI (US); William B. Kolb, West Lakeland, MN (US); Robert A. Yapel, Oakdale, MN (US); Peter T. Benson, North St. Paul, MN (US); William R. Dudley, Geneseo, NY (US); Raghunath Padiyath, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 462 days.

(21) Appl. No.: 12/602,692

(22) PCT Filed: Jun. 3, 2008

(86) PCT No.: PCT/US2008/065624

§ 371 (c)(1),
(2), (4) Date: Dec. 2, 2009

(87) PCT Pub. No.: WO2009/002665

PCT Pub. Date: Dec. 31, 2008

(65) Prior Publication Data

US 2010/0182728 A1 Jul. 22, 2010

Related U.S. Application Data

(60) Provisional application No. 60/945,730, filed on Jun. 22, 2007.

(51) Int. Cl.
*H05G 3/00* (2006.01)
*H01T 23/00* (2006.01)

(52) U.S. Cl.
USPC ..... 361/221; 361/214; 361/230

(58) Field of Classification Search
USPC ..... 361/221, 230, 214
See application file for complete search history.

(56) References Cited

U.S. PATENT DOCUMENTS

| | | | | |
|---|---|---|---|---|
| 2,952,559 | A | 9/1963 | Nadeau | |
| 3,730,753 | A | 5/1973 | Kerr | |
| 4,216,282 | A * | 8/1980 | Edwards et al. | 430/39 |
| 4,329,694 | A * | 5/1982 | Edwards et al. | 346/74.3 |

(Continued)

FOREIGN PATENT DOCUMENTS

| | | |
|---|---|---|
| JP | 2001-155894 | 6/2001 |
| JP | 2002-289394 | 10/2002 |

OTHER PUBLICATIONS

PCT International Search Report, PCT/US2008/065624.

*Primary Examiner* — Jared Fureman
*Assistant Examiner* — Lucy Thomas
(74) *Attorney, Agent, or Firm* — Julie Lapos-Kuchar

(57) ABSTRACT

Methods and apparatus (40) to neutralize the charge on a moving web (42) by splitting the field present on the web (42). One portion of the field is removed by a grounded element (55*a*, 55) proximate to, and optionally contacting, one side of the web (42). Proximate the opposite side of the web, the apparatus includes an ion source (57*a*, 57*b*, 57*c*), which provides ions to the web (42) to neutralize the charge remaining on the web (42), and a second grounded element (50*a*, 50*b*, 50*c*) positioned between the ion source (57*a*, 57*b*,57*c*) and the web (42). The methods provide a web (42) that is net neutralized and is also dual-side or bipolar neutralized.

20 Claims, 13 Drawing Sheets

(56) References Cited

U.S. PATENT DOCUMENTS

| | | | | | |
|---|---|---|---|---|---|
| 4,363,070 | A | | 12/1982 | Kisler | |
| 5,466,938 | A | * | 11/1995 | Nakayama et al. | 250/326 |
| 5,521,383 | A | * | 5/1996 | Furukawa et al. | 250/324 |
| 5,539,205 | A | * | 7/1996 | Reale | 250/326 |
| 5,581,905 | A | | 12/1996 | Huelsman et al. | |
| 5,694,701 | A | | 12/1997 | Huelsman et al. | |
| 5,964,988 | A | | 10/1999 | LaRose et al. | |
| 6,134,808 | A | | 10/2000 | Yapel et al. | |
| 6,312,543 | B1 | * | 11/2001 | Takeuchi et al. | 156/218 |
| 6,553,689 | B2 | | 4/2003 | Jain et al. | |
| 2003/0206755 | A1 | | 11/2003 | Wright et al. | |
| 2004/0074410 | A1 | | 4/2004 | Domes | |

* cited by examiner

APPARATUS AND METHODS FOR MODIFICATION OF ELECTROSTATIC CHARGE ON A MOVING WEB

CROSS REFERENCE TO RELATED APPLICATIONS

This application is a national stage filing under 35 U.S.C. 371 of PCT/US2008/065624, filed Jun. 3, 2008, which claims priority to U.S. Provisional Application No. 60/945,730, filed Jun. 22, 2007, the disclosure of which is incorporated by reference in its/their entirety herein.

TECHNICAL FIELD

The present disclosure relates to methods and apparatus for neutralizing or otherwise modifying the charge on a moving web, such as a polymeric web.

BACKGROUND

Ionically charged webs (e.g., polymeric webs) are common in web handling operations, where the web moves over and around various rollers, bars, and other web handling equipment. Ionic charge (i.e., static) builds up on the web from many causes including the contact and separation of the web from the various rolls and equipment.

Electrostatic charges on a web can produce a number of product quality damaging web coating problems. These charges can be very detrimental in the area of precision coating not only because of spark ignition hazards, but also because these static electricity charges can cause a subsequently coated liquid layer to be disrupted and form undesirable patterns. In addition to inhomogeneous charge patterns, homogeneous charge can also generate coating defects. These charge patterns can cause defects in processes such as coating and drying, In the photographic industry, for example, a significant non-uniform thickness distribution of a photographic coating material often results when such material is applied to a randomly charged web. Because of the high surface resistivity of high dielectric materials, such as polyester based materials and the like, used in photographic film, it is fairly common to have relatively high polarization and surface charge levels, of varying intensity and polarity, occupying web areas closely adjacent one another. The use of such coating materials as a component of a photographic positive or negative, for example, often requires the use of relatively thick coatings to provide at least a minimum thickness coating throughout the web and thereby compensate for such non-uniform thickness distribution which necessarily results in an increase in the use of relatively costly coating materials in order to produce an effective coating thickness. Visual effects such as mottle are also a consequence of coating non-uniformly charged webs. Past practices included either tolerating this non-uniform charge distribution and its disadvantages or attempting to neutralize a randomly charged web as much as possible prior to applying the coating materials.

Various techniques for supposedly neutralizing charged webs are known.

One old technique, described in U.S. Pat. No. 2,952,559, involves passing a charged web between a pair of opposed grounded pressure rollers that are spring-force biased against opposite web surfaces for the purpose of neutralizing bounded or polarization-type electrostatic charges and then blowing ionized air onto surfaces of the web to first neutralize surface charges and then establish a particular web surface charge level prior to coating same. This resulting surface charge level is compensated for by applying a voltage to the coating applicator during the actual coating process having a polarity that is opposite to that of the web surface charge.

Another technique, described in U.S. Pat. No. 3,730,753, involves "flooding" a web surface with charged particles of a first polarity so as to generally uniformly charge the surface and thereafter removing the charge imparted to said web surface so as to leave the surface generally free of charge. The amount of charge added to and/or the amount of charge removed from the web surface may be so controlled that the charge variation and the net charge on the surface is lowered to an acceptable low level.

However, the detrimental effects on precision coating may occur even when the homogeneous charge is balanced to give a net zero charge. To ensure that static charge on webs does not adversely affect the coating and/or drying process, it is desirable to precisely neutralize webs in continuous processes. This is currently not possible using commercially available neutralization systems.

Commercially available neutralization systems, which are useful but do not solve the problem, include:

Air Ionizers, which provide a source of ionized air. Air naturally contains ions. However, these ions are not sufficiently abundant in most cases to neutralize static charges rapidly enough to protect static sensitive devices. Further, air ions are removed by HEPA and ULPA filters in clean rooms.

Electrical Static Eliminators, which consist of one or more electrodes and a high voltage power supply. Ion generation from electrical static eliminators occurs in the air space surrounding the high voltage electrodes. There are various commercial sources for electrical static eliminators, such as MKS Ion Systems and Simco (an Illinois Tool Works company).

Induction Static Eliminators are passive devices that generate ions in response to the electric field emanating from a charged object. Examples of common induction static eliminators include Static String™, tinsel, needle bars, and carbon brushes.

Nuclear Static Eliminators, which create ions by the irradiation of air molecules. Most models use an alpha particle emitting isotope to create ion pairs to neutralize static charges. These are often also called Nuclear Bars.

Each of these neutralization systems provide a means to attain a web that is net neutralized (i.e. the magnitude of electric field, as measured with a common static meter is substantially lower than was initially, provided the initial charge was substantial). However, the net neutralized web may still have substantial charge.

SUMMARY

The present disclosure is directed to apparatus and methods that modify the surface charge on an item, such as a moving web. In many embodiments, the apparatus and methods of this disclosure provide an item that is net neutral. In these embodiments, not only is the item net neutral but generally is also dual-side neutral, whereby both sides of the item are neutral. The item may be a discrete item or a continuous web. The method and apparatus are particularly suited for net neutralizing items that have been exposed to static charge creating equipment such as corona treaters (e.g., AC corona treaters), nip rolls, pack rolls, tacky rolls, and other equipment that generates bipolar charge. The resulting net neutralized item can then be processed without many of the typical charge-associated disadvantages discussed above in the Background.

In accordance with this disclosure, the present apparatus splits the field arising from a charged item. One portion of the field is directed to a first grounded element proximate to, and optionally contacting, a first side of the item. Another portion of the field is directed to a second grounded element proximate to a second side of the item. The apparatus includes an ion source that provides ions to the region between the second side and second grounded element. In some embodiments, the second ground element is foraminous, apertured, or otherwise sufficiently porous to allow passage of ions therethrough. Typically the second grounded element is no greater than ten times the distance from the item surface than the item is thick (e.g., no more than 5 times the distance).

Also in accordance with this disclosure, a method for modifying the charge on an item (e.g., providing a bipolar net neutral item) is provided. The method includes modifying the field arising from a charged item by placing a grounded element proximate to one side of the item and introducing ions into the gap between the item and grounded element. A handling line, such as a web handling line, may include one or more systems that neutralize by splitting the field arising from the charged item; any or all of these multiple neutralizer systems may be on the same or different sides of the item.

The ions that neutralize the surface of the item can be obtained from suitable ion sources that include a wire, blade, and other small radius element connected to a power source (e.g., a DC source or an AC source) to provide the desired ions. Other examples of ion sources include ion guns, ion blowers, alpha radiation, and X-rays.

The apparatus and methods of this invention are particularly useful when used upstream of equipment that includes tight clearance for the item passing therethrough. For example, a web net neutralized according to this invention has less of a tendency of touchdown, for example, in a gap dryer.

In one particular aspect, this disclosure provides an apparatus for net neutralizing a surface. The apparatus includes a grounded element positionable at least in close proximity to a first side surface, and an ion source and a second grounded element positionable in close proximity to a second side surface, the second grounded element positioned between the ion source and the second side surface. In some embodiments, the grounded element is positionable to contact the first side surface, and can be, for example, a web handling roll. The second ground element, on the second side surface, can be a foraminous element, such as a screen. The ion source can be a conductive element connected to a power source such as a DC, AC or high voltage power source. The conductive element could be a wire or other element with a small radius or a toothed blade. Other ion sources include an ion gun, an ion blower, alpha radiation source, or an X-ray source.

In another particular aspect, this disclosure provides a method for neutralizing a surface, by providing a grounded element at least in close proximity to a first side surface, and providing an ion source and a second grounded element in close proximity to a second side surface, the second grounded element positioned between the ion source and the second side surface. The surface can be a surface of a dielectric web.

In yet another particular aspect, this disclosure provides a web handling process that includes a web source providing the web, a corona treater positioned to act upon the web, a bipolar neutralization apparatus that has a grounded roller positioned against a first side of the web and an ion source and a second grounded element positioned in close proximity to a second side of the web, with the second grounded element positioned between the ion source and the second side. A gap dryer can be positioned downweb of the bipolar neutralization apparatus.

Another web handling process of this disclosure includes a web source providing the web, a bipolar neutralization apparatus that has a grounded roller positioned against a first side of the web and an ion source and a second grounded element positioned in close proximity to a second side of the web, the second grounded element positioned between the ion source and the second side, and a coating station downweb of the bipolar neutralization apparatus, and a gap dryer downweb of the coating station. A corona treater may be positioned upweb of the bipolar neutralization apparatus.

In each or either of these web handling processes, the second grounded element can be a foraminous element, such as a screen. The ion source can be a conductive element such as a wire or other small radiused element or a toothed blade connected to a power source such as DC, AC or high voltage, or the ion source can be an ion gun, an ion blower, alpha radiation source, or an X-ray source.

Although many systems are known for neutralizing the net charge on a web, the present disclosure provides various apparatus and methods for modifying or neutralizing the total charge on a web, and on both sides of the web.

Figure 1:
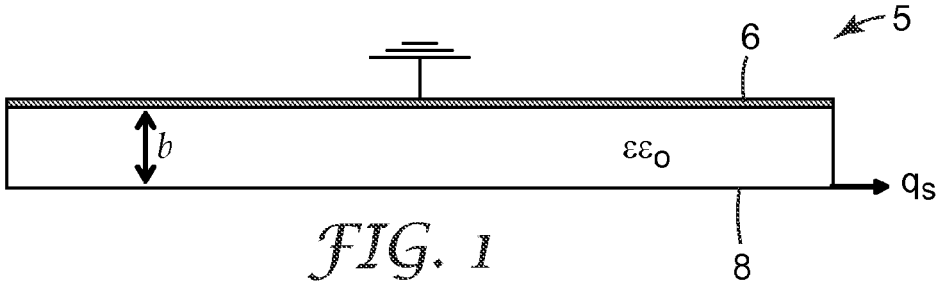
FIG. 1 is a schematic illustration of a web with a grounded conductive backing on a first side and a surface charge on the opposite side.

These and various other features which characterize the apparatus and methods of this disclosure are pointed out with particularity in the attached claims. For a better understanding of the apparatus and methods of the disclosure, their advantages, their use and objectives obtained by their use, reference should be made to the drawings and to the accompanying description, in which there is illustrated and described preferred embodiments of the invention of this disclosure.

DETAILED DESCRIPTION

The present disclosure is directed to an apparatus and methods that provide an item that is dual-side neutral or bipolar neutral (not just net neutral), and preferably, an item that has both sides dual-side neutral. Examples of materials for the items to be net neutralized according to his invention include dielectric materials (e.g., polyester, polyethylene, polypropylene), cloths (e.g. nylon), papers, laminates, glass, and the like. The items may include a conductive layer or an antistatic layer. The apparatus and methods of this disclosure are particularly suited for items that include a dielectric material. In some embodiments, the item is a web. By use of the term "web" herein, what is intended is a web of sheet stock, having an extended length (e.g., greater than 1 m, usually greater than 10 m, and often greater than 100 m), a width (e.g., between 0.25 m to 5 m), and a thickness (e.g., 10-150 micrometers, e.g., up to 1500 micrometers). In other embodiments, the item is a discrete or individual item, rather than an extended length. For example, a sheet or page of material might have e.g., a length of 0.5 meter and a width of 0.5 meter. Discrete items may be general planar or have a three-dimensional topography.

As provided above in the Background, commercially-available neutralization systems are known to provide means to attain webs that are net neutralized (i.e., the magnitude of electric field, as measured with a common static meter is substantially lower than it was initially, provided the initial charge was substantial). However, the net neutralized web may still have substantial charge.

For example, a web in a freespan with a sinusoidal surface charge distribution of mean zero, amplitude $A_s$ and spatial period $X_s$, will have a field above or below the web arising from the surface charge distribution that decays rapidly, and the web will appear to be neutral when measured by a static meter located a distance of several periods ($X_s$) away from the web. The web will appear neutral even though the actual rms value of surface charge may be quite large.

There are many other situations where a web can appear to be neutral when measured with standard electrostatic sensors, and yet have a substantial charge distribution. These charge distributions can cause defects in web-based processes such as coating and drying, and a method is needed for neutralizing these charge distributions to a level such that defects are reduced or eliminated. The level to which these charge distributions must be neutralized is a function of the process (i.e., line speed, coating and drying methods), materials (i.e., coating solution, film thickness) and the particular defect in question. For example, commercial neutralizers are sufficient for eliminating arcing defects, but not for eliminating some coating and drying defects. The methodology of this invention is targeted at eliminating or modifying charge distributions such that coating and/or drying defects are reduced, and/or web cleanliness is enhanced. Additionally, by net neutralization of the charge on the item, downstream equipment that includes tight clearance can be readily used. For example, a net neutralized item has less of a tendency to touchdown, for example, in a gap dryer. An exemplary gap dryer is described in U.S. Pat. No. 6,134,808, entitled "Gap Drying With Insulation Layer Between Substrate and Heated Platen", to Yapel et. al., issued Oct. 24, 2000, which is incorporated by reference as if re-written herein.

In this description, we refer to "net charge", or "polar charge", and "single side charge", or "bipolar charge", when discussing charge distributions on dielectric web. Net charge is defined as the apparent charge per unit area on a dielectric web as inferred from using a fieldmeter to measure field with the web in a free-span (far from other objects). The gap between the fieldmeter and web is typically 0.5-2.0 inches. The static measurement thus obtained is a function of the charge distribution over the spot size of the measuring probe, which would typically be an area with diameter on the order of inches. The charge measured in this way is also referred to as polar charge. "Net neutralization" refers to the reduction of the magnitude of net charge, or polar charge, on a web. A low net charge measurement does not imply that the charge distribution over the spot size area is everywhere low, but rather that some average of the charge distribution over the spot size area is low. The sinusoidal charge distribution described above would manifest itself as having a low net or polar charge if the period of the distribution was much shorter than the spot size diameter.

"Single-side charge" is the apparent charge per unit area inferred from using a fieldmeter or voltmeter to measure the field above or the potential of one surface of the web while the other surface of the web is contacting a grounded conductor. The gap between the fieldmeter or voltmeter and the web surface is usually 0.5-5.0 millimeters. The static measurement thus obtained is a function of the charge distribution over the spot size of the measuring probe, which is typically an area with diameter on the order of millimeters. A charge distribution that results in no substantial net charge, but does result in a substantial single-side charge, is sometimes referred to a "bi-polar charge distribution". "Single-side neutralization" or "bipolar charge neutralization" refers to the reduction of the magnitude of single-side charge or bipolar charge on a web. A low single-side charge measurement does not imply that the charge distribution over the spot size area is everywhere low, but rather some average of the charge distribution over the spot size area is low. The sinusoidal charge distribution described above would appear to have a low single-side or bipolar charge if the period of the distribution was much shorter than the spot size diameter of the measuring device.

As another simple example of bi-polar charge, consider a dielectric web with a uniform charge distribution, $q_s$, on one surface and a uniform charge distribution, $-q_s$, on the opposite surface. In free span, the net charge or polar charge measurement would be zero (because the sum of the top and bottom charge is zero). The single side charge measurement would yield either $q_s$ or $+q_s$, depending on which side was placed down on a grounded object. A commercial neutralizer would have little impact on this bi-polar charge, as the web is already net neutral.

As another example of a bipolar charge distribution, consider a web with a sinusoidal charge distribution with a non-zero mean, $p(x)=A_s \sin(2\pi x/X_p)+q_s$, on one surface and a charge distribution of $-p(x)$ on the opposite surface. If the net charge measurement in the free span is performed using a spot size with diameter greater than a few $X_p$, the web will appear to have no substantial net charge. A single-side charge measurement scan performed using a spot size with diameter larger than a few $X_p$ would yield either $+q_s$ or $-q_s$, depending on which surface was placed against the grounded object. If a single-side measurement scan were performed using a spot size diameter much smaller than $X_p$, the sinusoidal nature of the single-side charge would be revealed.

As yet another example of a bipolar charge distribution, consider a web with a random charge distribution R(x) on one side and R(x) on the other side. The first and second moments of R(x) converge to $+q_s$ and $A_s$, respectively, when integrated over a spot size $X_s$. If the net charge measurement in the free span is performed using a spot size with diameter greater than $X_p$, the web will appear to have no substantial net charge. A single-side charge measurement scan performed using a spot size with diameter larger than $X_p$ would yield a constant single side charge, $+q_s$ or $q_s$, depending on which surface was placed against the grounded object. If a single-side measurement scan were performed using a spot size diameter much smaller than $X_p$, the random nature of the single-side charge would be revealed.

An initially charged dielectric web is considered "dual-side neutralized" if both the net charge or polar charge, and the single-side charge or bipolar charge, have been reduced to a desirable level. Note that the terms "net charge" and "single-side charge" are inferred through non-invasive electrostatic measurements, and do not imply nor require knowledge of the particular locations or magnitudes of the actual charge distributions. The charge distributions may exist on the surface of the dielectric or be internal to the web or both. More sensitive electrostatic sensing probes than those mentioned above (with smaller spot sizes than mentioned above) may be used to infer net charge or polar charge, and single-side charge or bipolar charge, at finer length scales, depending on the sensitivity desired.

The method and apparatus described in this disclosure provide for the reduction of both polar and bipolar charge on webs at least on the length scales discussed above, but including smaller length scales that may not be readily detectable using standard electrostatic measurement equipment. The term "neutralization" does not imply that all charge has been completely eliminated, as there may be, for example, residual charge that generates external fields too weak to cause defects, or that, for example, a double layer has been formed that essentially weakens the external field to a level that brings defects into an acceptable range, or that, for example, the length scale of the remaining bipolar charge distribution is small enough so that defects associated with the original bipolar charge distribution have been reduced or eliminated.

FIG. 1 illustrates an isolated web with one grounded side and a uniform surface charge, $q_s$, on the other side. Web 5 of FIG. 1 a first side 6 and an opposite second side 8 with a thickness b therebetween. Side 6 is grounded, such as by any suitable element that can be positioned in sufficiently close proximity to or in contact with side 6. In many processes, side 6 is grounded via contact equipment of a web handling process, such as a roll, that is grounded. The potential at side 8 of web 5 is given by:

$$\phi_s = \frac{bq_s}{\varepsilon\varepsilon_o} \tag{1}$$

where $\in_o$ and $\in$ are the electric permittivity of free space and relative permittivity of the web, respectively. For isolated web 5, the electric field outside web 5 is zero, while the electric field inside the web is given by:

$$E_w = -\frac{q}{\varepsilon\varepsilon_o} \tag{2}$$

As an example, for a case with surface charge $q_s=10^{-5}$ C/m$^2$, $\in=5$ and b=0.002 inch, the potential at side 8 in free span is $\phi_s=11.5$ V, and the field within web 5 is $E_w=226$ kV/m. The voltage of web 5 as measured with a fieldmeter at a 1 inch gap is 11.5 V. Since the field outside the isolated web is zero everywhere, standard neutralizing devices would have very little impact on the surface charge.

FIG. 1 and the associated discussion above is just one very simple example of a bipolar charge distribution that cannot be readily neutralized using commercial ionizers. Additionally, there are many other forms of bipolar charge distributions that cannot be readily neutralized using commercial ionizers. The methods described in this disclosure can be used to neutralize many problematic bipolar charge distributions that cannot be neutralized using commercial or previously known ionizers.

Isolated web 5 shown in FIG. 1 has no field lines external to web 5 because of being grounded on side 6. Commercial ionizing neutralizers, such as those discussed in the Background, rely on the field emanating from or terminating at a charged web to pull in ions for neutralization. Since there is no field external to isolated web 5 shown in FIG. 1, commercial ionizing neutralization devices are not effective at reducing what may be a substantial charge on web 5. However, when a second ground element is brought near the dielectric surface of the web, the electric field due to the charge is split between the grounded backing side and the second ground element.

Figure 2:
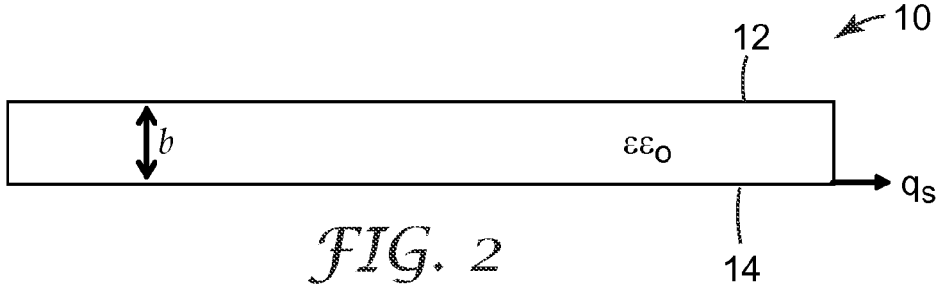
FIG. 2 is a schematic illustration of a web with no conductive component and a surface charge on one side.

Compare the above situation with FIG. 2, which illustrates a web with no grounded side. In FIG. 2, web 10 has a first side 12 and an opposite second side 14 with a thickness b therebetween. For an exemplary case where $q_s=10^{-5}$ C/m$^2$, the magnitude of the electric field outside of isolated web 10 is 565 kV/m everywhere, and the voltage of web 10 as measured with a fieldmeter at a 1 inch gap is 28.7 kV. For this situation, the field outside web 10 is very strong, and commercial neutralizers could be used to substantially net neutralize this web.

Note that, for the same surface charge, the surface potential (voltage) of a 0.002 inch thick web with a conductive side (e.g., as in FIG. 1) is more than 3 orders of magnitude lower than for the case of a 0.002 inch web without a conductive side (e.g., as in FIG. 2). This is true even though both webs have substantial charge distributions.

Figure 3:
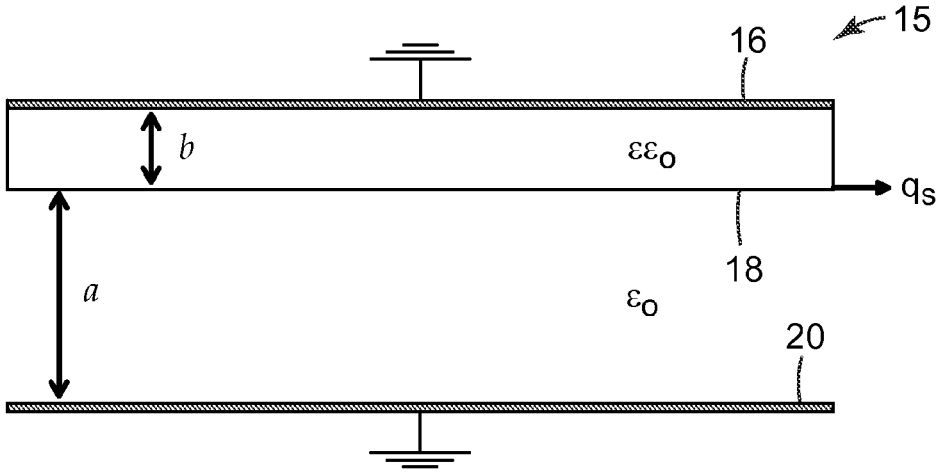
FIG. 3 is a schematic illustrate of a web with a grounded conductive backing on one side and a surface charge on the opposite side, with the opposite side in close proximity to a grounded conductive element.

Referring now to FIG. 3, an example is provided where a web with a grounded side is placed a distance a above a grounded element, such as a conductive plate. In use, the charge on the web is split between the two grounded elements. In FIG. 3, web 15 having a grounded first side 16, an opposite second side 18 and a distance b there between is illustrated. Second side 18 is distance a above a grounded element 20. The electric field in the air gap beneath web 15 (i.e., between side 18 and plate 20) is given by:

$$E_g = -\left(\frac{b}{b + a\varepsilon}\right)\frac{q_s}{\varepsilon_o} \tag{3}$$

and the electric force per unit area on web 15 is given by:

$$T_w = -\left(\frac{b}{b + a\varepsilon}\right)^2 \frac{q_s^2}{2\varepsilon_o} \tag{4}$$

Equation 4 indicates that web 15 will be attracted to ground plate 20, and this "electric pressure" will increase as the gap decreases. As the gap a becomes large compared to web thickness b, the force of attraction will approach zero. As the gap a becomes small compared to web thickness b, the force per unit area will approach that of a web without a conductive backing, $$-\frac{q_s^2}{2\varepsilon_o}.$$

For the parameters given above in the discussion of FIGS. 1 and 2, this web 15 has a voltage of only 11.5 V. However, the limiting force of attraction to bottom plate 20 (also referred to as "pinning force") is 5.57 N/m$^2$. Furthermore, the voltage reading of web 15 will increase linearly with surface charge, but the force of attraction will increase quadratically. This is just one example of many situations where a nominally "neutral" web (as measured with a fieldmeter at a 1 inch gap) can have substantial charge. In some situations, the fields due to this charge can give rise can to problems in coating, drying, web handling and cleanliness. For example, these electric forces can lead to undesirable directionality of web 15 in ovens where the web must float over grounded objects. It is also well known that fluid interfaces can be substantially disturbed by the action of electric fields, and these disturbances can lead to product defects in coated materials.

Figure 4:
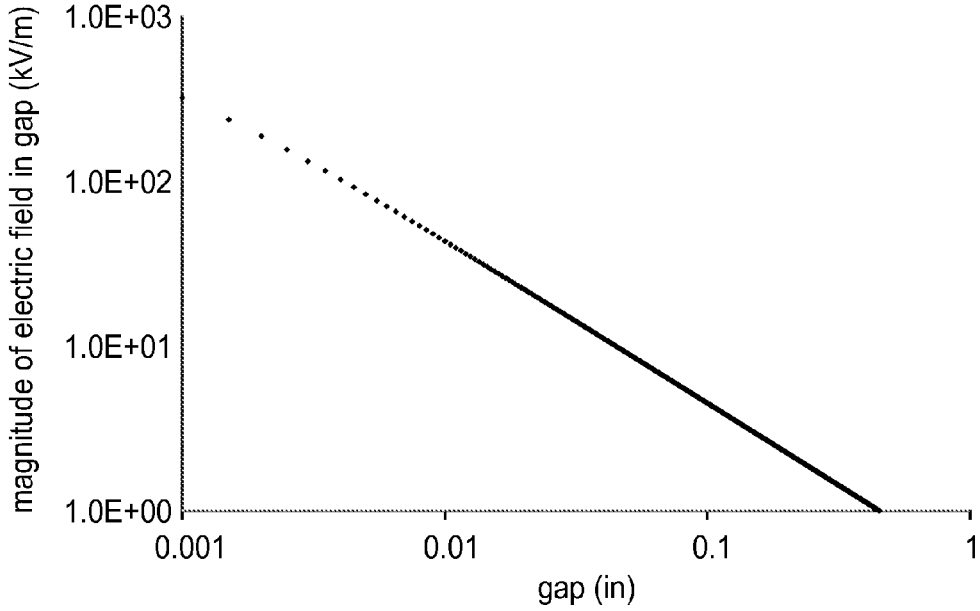
FIG. 4 is a graphical representation of the magnitude of an electric field in the gap between a grounded conductive plate and a web surface having constant charge, with a grounded conductor on the opposite web surface.

Of particular interest is the field outside the web (e.g., in the gap between side 18 and grounded element 20), as given by Equation 3, and plotted as a function of the gap in FIG. 4. The same parameters as used in respect to FIG. 3 above were used in plotting FIG. 4. The field in the gap increases as the gap decreases, and a substantial field exists in the gap, even at gaps one or two times the web thickness b. Having established a significant field outside the web, ions can now be introduced into the gap and used to neutralize the web.

Figure 5:
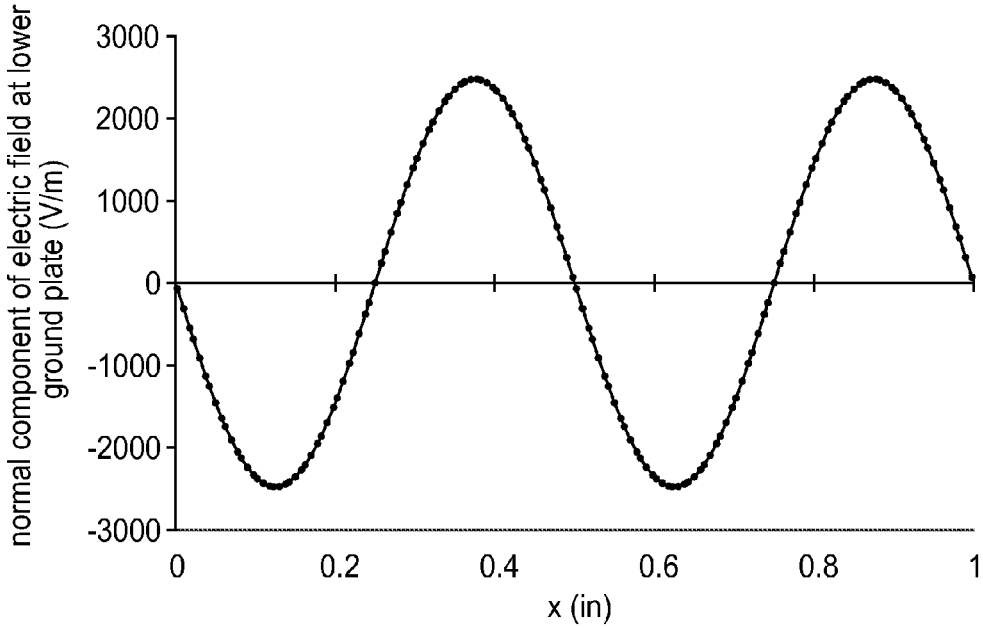
FIG. 5 is a graphical representation of the field at a bottom plate for a 0.002 inch web with a grounded surface and a sinusoidal charge distribution with mean zero, rms value of $10^5$ C/m$^2$ and a period of 0.5 inches; the web to plate distance is 0.2 inch.

Consider for example, an isolated web with a grounded backing on one side and a sinusoidal bipolar charge distribution with mean zero and rms value $q_s$, $$p(x) = q_s\sqrt{2}\sin\left(\frac{2\pi x}{X_s}\right) \tag{5}$$

on the other side. For web thickness on the order of $X_s$ or larger, the field below the isolated web dies off rapidly at a distance on the order of $X_s$. As web thickness is decreased below $X_s$, the field external to the web dies off more rapidly. For isolated webs with a thickness a couple of orders of magnitude smaller than $X_s$, the field is mainly confined within the web and the field external to the web is very weak. Now consider the situation where a grounded conductive plate is placed a distance away from the dielectric side of the web. For a gap small compared to the period of the distribution, the field in the gap locally becomes similar to the field in a gap with constant charge equal to the local value of the charge distribution. The normal component of the field at the bottom plate is shown in FIG. 5, for the case of a gap two orders of magnitude larger than the web thickness, and one order magnitude smaller than the period of the charge distribution. Even at this large gap to web thickness ratio, the field in the gap is in the kV/m range.

Figure 6:
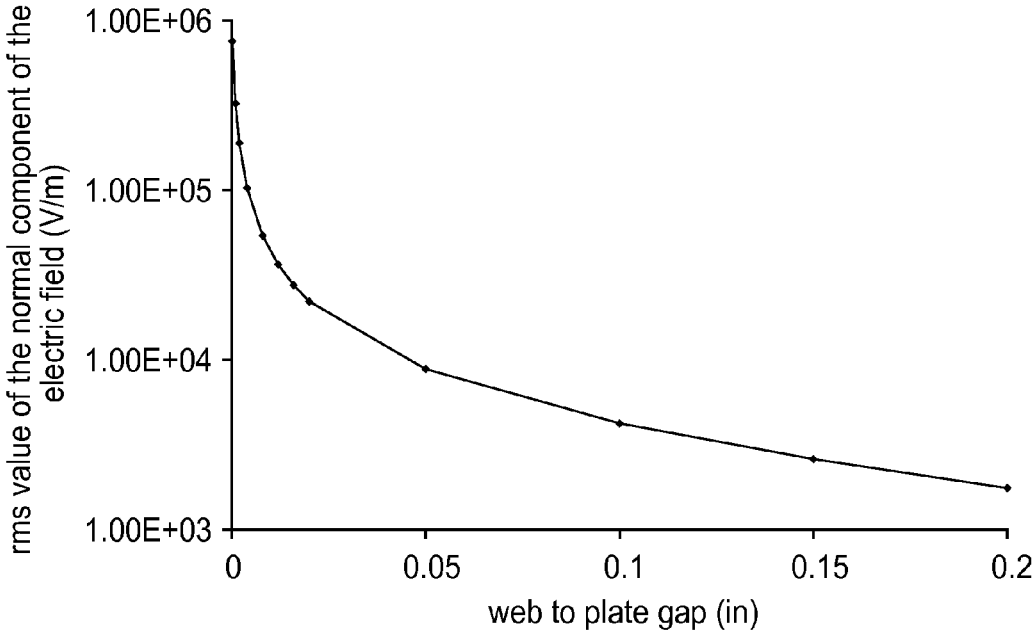
FIG. 6 is a graphical representation of the field at a bottom plate as a function of web to plate gap for a 0.002 inch web with a grounded surface and a sinusoidal charge distribution with mean zero, rms value of $10^5$ C/m$^2$ and a period of 0.5 inches.

FIG. 6 shows the rms value of the normal component of the electric field at the grounded element as a function of gap distance. From FIG. 6, quite large fields can be achieved for gaps more than an order of magnitude larger than the web thickness. The rms values in FIG. 6 can be converted to peak values by multiplying by $\sqrt{2}$. As in the case of constant surface charge, the presence of the grounded element generates a significant field in the gap, and now ions can be introduced into the gap to neutralize this bipolar charge distribution.

Figure 7:
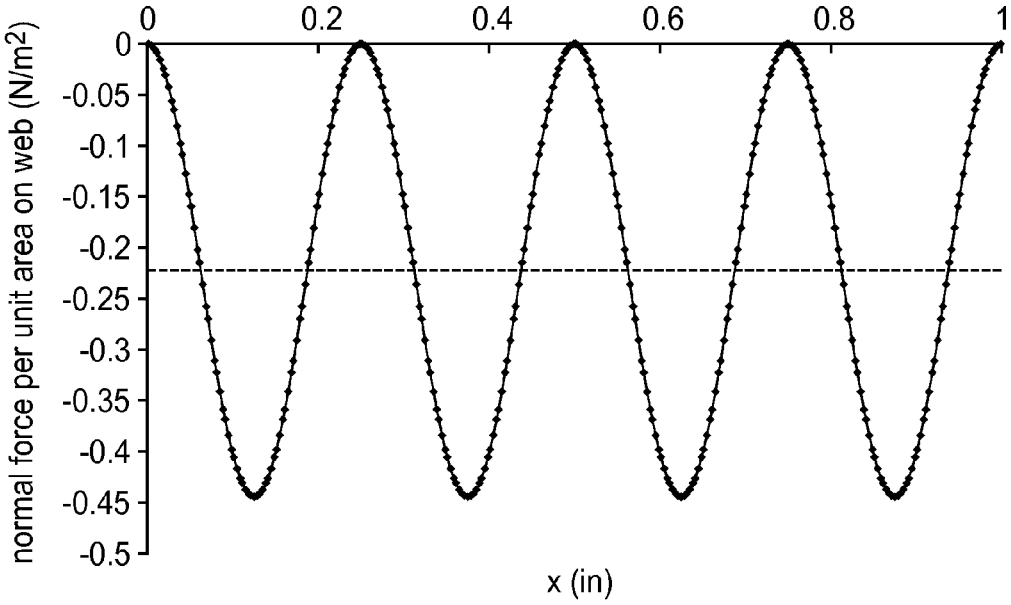
FIG. 7 is a graphical representation of the normal force on a 0.002 inch web with a grounded surface and a sinusoidal charge distribution with mean zero, rms value of $10^5$ C/m$^2$ and a period of 0.5 inches; the web to plate distance is 0.001 inch.
Figure 8:
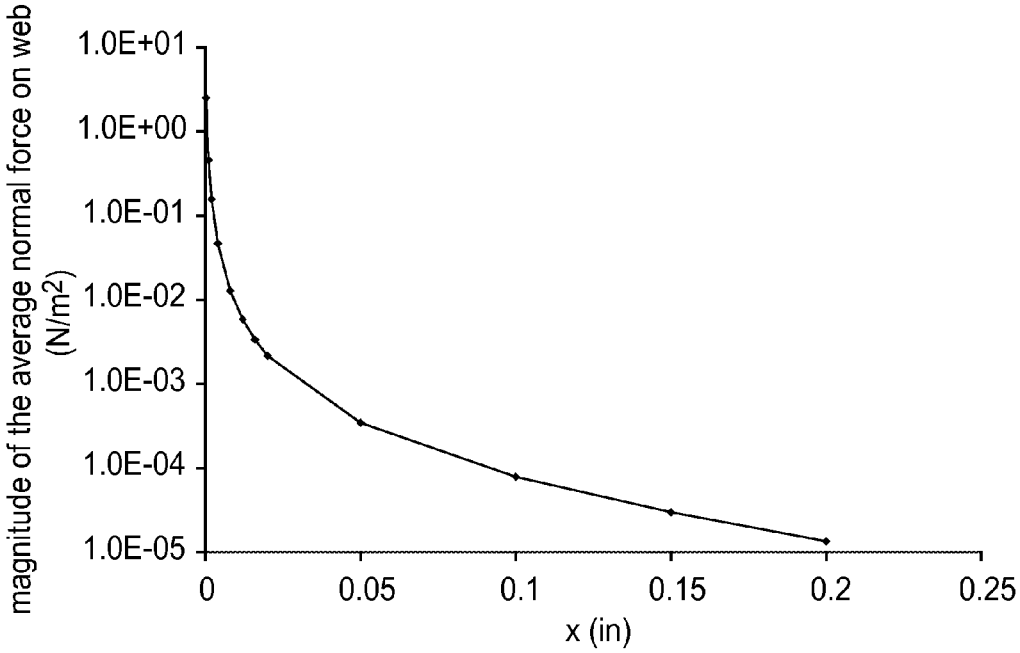
FIG. 8 is a graphical representation of the normal force of the field as a function of web to plate gap for a 0.002 inch web with a grounded surface and a sinusoidal charge distribution with mean zero, rms value of $10^5$ C/m$^2$ and a period of 0.5 inches.

Similar to the case of a constant surface charge discussed in respect to FIG. 1, these sinusoidal charge distributions, such as of FIG. 5, can also lead to undesirable effects in coating, web handling, drying and cleanliness. For example, FIG. 7 shows the normal force per unit area (normal component of the electric stress tensor) profile on the web for a gap one order of magnitude smaller than the web thickness and four orders magnitude smaller than the period of the charge distribution. FIG. 8 shows the magnitude of the average normal component of the electric stress on the web as a function of gap for the web thickness three orders of magnitude smaller than the period of the charge distribution.

In order to keep the calculations simple, the theoretical examples discussed above are for a web with a grounded backing on one side and a surface charge distribution on the other side. In practice, the bipolar charge distributions may be present on the surface of, or internal to, a dielectric material.

In general, the neutralization method of this disclosure involves bringing a conductive grounded element in close proximity to a first dielectric surface (e.g., a first surface of a web) and then introducing ions into the gap between the element and the surface. Also included is a method of bringing a first conductive grounded element in close proximity to a first dielectric surface (e.g., a first surface of a web) and bringing a second conductive grounded object in close proximity to a second dielectric surface (e.g., an opposite second surface of a web) and then introducing ions into one or both gaps. The degree to which neutralization of the bipolar charge can be achieved depends on the proximity of the grounded conductive element(s) and on the amount and type of ions that are introduced into the gap.

Figure 9:
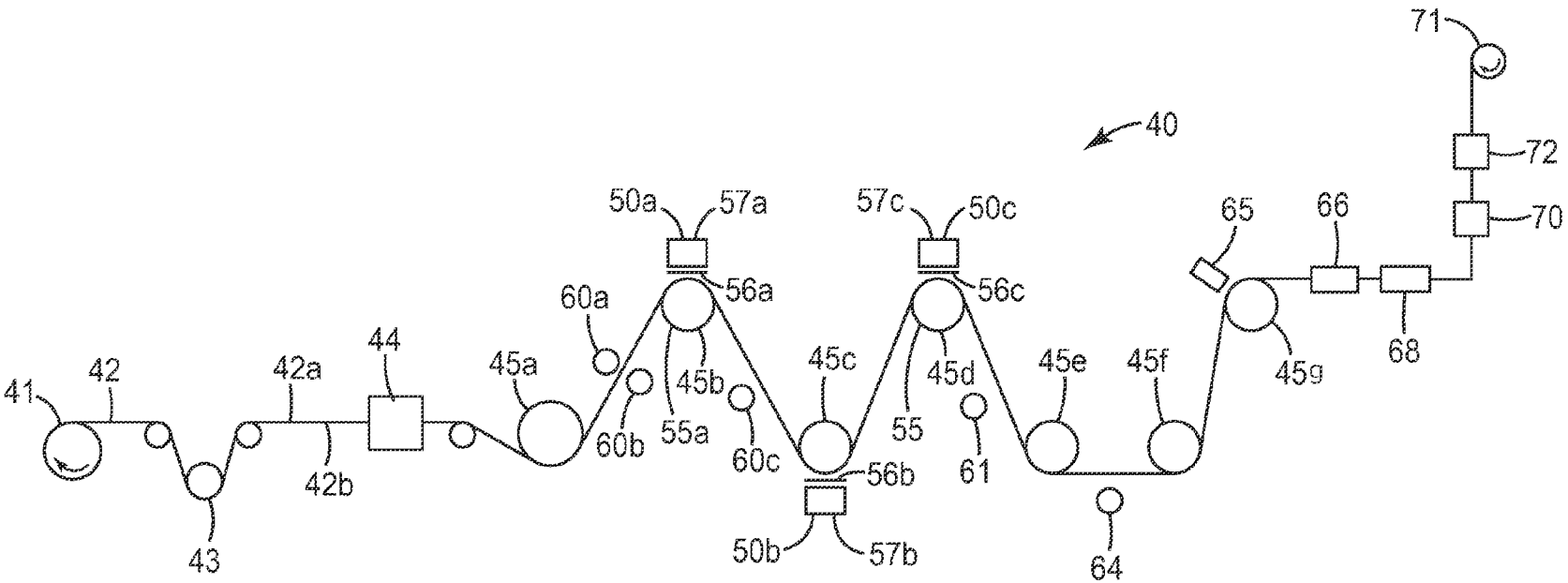
FIG. 9 is a schematic diagram of a portion of a web handling apparatus that includes two bipolar neutralizers according to this disclosure.

Referring to FIG. 9, a first practical example is schematically illustrated. FIG. 9 is a schematic diagram of a typical web line incorporating at least one neutralization system according to this disclosure. This particular web handling apparatus of FIG. 9 includes two neutralization systems.

FIG. 9 illustrates a web handling process 40 that has a web source 41 for web 42 (having a first side 42*a* and a second side 42*b*) and at least one neutralization system according to this disclosure. The web follows a path from web source 41 to the neutralization system(s) and to the end that has various rollers, nips, tensioners, and other well known web handling equipment. In some embodiments, web 42 may progress to a coating operation which includes a coater (e.g., a die) and a dryer (e.g., a gap dryer).

Web source 41 may be an elongate length of web 42 wound as a roll, which could have a core or be coreless. Alternately, web source 41 could be an extrusion process, forming web 42 immediately prior to web handling process 40. In most embodiments and as illustrated in FIG. 9, however, web source 41 is a roll of web material. As web 42 is unrolled from web source 41, both sides 42*a*, 42*b* pick up charge; such phenomenon is well known.

In this embodiment, web 42 from web source 41 is fed through a series of tensioner rolls 45, particularly rolls 45*a*, 45*b*, 45*c*, etc., which are well known in the web handling industry. At each tensioner roll 45, web 42 picks up charge, due to the contact and release from each of the rolls. Typically, the side of web 42 that contacts the roll picks up charge. Process 40 may include other web processing equipment such as drive nips and idler rolls, as well as other rolls that are conventional, well known web handling equipment. It is generally well known to limit the number of contact points (i.e., rollers, nips, bars, etc.) with web 42 during processing, in order to inhibit continued accumulation of charge. In this illustrated process, process 40 includes a corona treater 44, as will be further discussed below.

In accordance with the invention of this disclosure, web handling process 40 includes at least one neutralization system or neutralizer, which modifies the accumulated charges on web 42 and preferably neutralizes the web. In many and in preferred embodiments, both sides 42*a* and 42*b* are dual-side neutral after the neutralizer(s). Process 40 includes at least one neutralizer 50, and in this embodiment includes three neutralizers 50*a*, 50*b*, 50*c*.

Each neutralizer 50 includes a grounded element in at least close proximity to one side (e.g., side 42*b* for neutralizer 50*a*) of web 42 and an ion source in close proximity to the other side (e.g., side 42*a* for neutralizer 50*a*) of web 42. In this embodiment, neutralizer 50*a* includes a grounded roll 55*a* (which also is a tensioner roll) and an ion source 57*a*. Similarly, neutralizers 50*b*, 50*c* include a grounded roll 55*b*, 55*c* and an ion source 57*b*, 57*c*.

Ion source 57 can be any suitable element, generally a conductive element, that provides ions, either anions or cations, to web 42. Examples of suitable ion sources include a single or multiple wires, a blade, and other small radius element connected to a power source (e.g., a DC source or an AC source) to provide the desired ions. Other examples of ion sources include ion guns, ion blowers, alpha radiation, and X-rays.

Positioned between ion source 57 and web 42 (i.e., web side 42*a*) is a second grounded element 56. In this embodiment, neutralizer 50*a* includes a grounded element 56*a*; similarly, neutralizers 50*b*, 50*c* include grounded elements 56*b*, 56*c*. Grounded element 56 controls the flow of ions from ion source 57 to web side 42*a* by providing a shield. Grounded element 56 may be continuous and solid, or may be a foraminous, e.g., having pores or apertures therethrough. Examples of foraminous elements include screens, porous ceramic plates, etched elements, and other items that are porous or apertured.

Process 40, in the illustrated embodiment, also includes conventional web neutralization systems, such as nuclear bars 60*a*, 60*b*, 60*c* and 61. These conventional neutralization systems facilitate the neutralization of web 42 by providing web 42 at least substantially net neutral; these conventional neutralization systems, however, are not able to provide a dual-side neutral web 42.

Corona treater 44 (e.g., an AC corona treater) is optional, and used in some but not all of the exemplary trials presented below. It is well known in the art of web handling that contact items such as corona treaters, nip rolls, pack rolls, tacky rolls, laminators, and other equipment that contacts the item provide bipolar or static charge to the item. The present method and apparatus net neutralize the items (e.g., web) downstream of the charge-creating equipment.

In the illustrated process 40, after corona treater 44, the web is net neutralized using two conventional nuclear bars 60*a*, 60*b*. The bipolar, or single side, neutralization occurs in the following steps:

1. While side 42*b* of web 42 is in contact with and wrapped on grounded roller 45*b*, side 42*a* of web 42 is then bipolar (or single-side) neutralized using a manifestation of the invention of this disclosure.
2. Immediately after web 42 leaves the first bipolar neutralizer 50*a*, the web is net neutralized from the bottom (opposite) side 42*b* using nuclear bar 60*c*.
3. Steps 1 and 2 are repeated as often as necessary and be performed on opposite sides of the web if desired. For example, if removal of top-side bipolar charge is desired, only two bipolar neutralizers 50*a*, 50*c* are applied to the top side 42*a* of the web.

After the neutralization stations 50*a*, 50*b*, 50*c*, the net (freespan) potential can be measured, such as by using a Monroe 177A fieldmeter 64 with a 10 kV/cm industrial probe at a gap of 1 cm. While the web is wrapped around a grounded roller 45, the top-side potential can be measured, such as by using a Trek 400 voltmeter (±2000V range) with a high-speed probe 65 at a gap of about 2 mm.

The resulting net neutralized web, when coated, has improved characteristics than a non net neutralized web. For example, less or no coating defects (e.g., drying patterns, streaking, etc.) are seen, and there is less deviation of the web from its intended path (i.e., less undesirable directionality), which is particularly beneficial when equipment with tight path tolerances is used. For example, a gap dryer or gap drier has a very low clearance or tolerance for web path deviation therein. Gap dryers (or gap driers) are described, for example, in U.S. Pat. Nos. 5,581,905 (Huelsman et al.), 5,694,701 (Huelsman et al.) and 6,553,689 (Jain et al.), all of which are incorporated herein by reference.

EXAMPLES

The following non-limiting examples illustrate various embodiments of this disclosure.

Using the set-up of FIG. 9, various runs were conducted to determine suitable process configurations to inhibit touchdown of the web. "Touchdown" is the contact of the web to a side wall of the dryer, due to the field formed by a single-side charge on the web. It is well known that a coating (e.g., adhesive coating) when wet, is grounded and neutralizes the side having the coating thereon, thus leaving the other side charged. In each of the three tests, undesirable directionality of the web in the drying oven (after coating) was eliminated and the quality of the coating in general increased with the application of these bipolar neutralization devices.

Example 1

Figure 10:
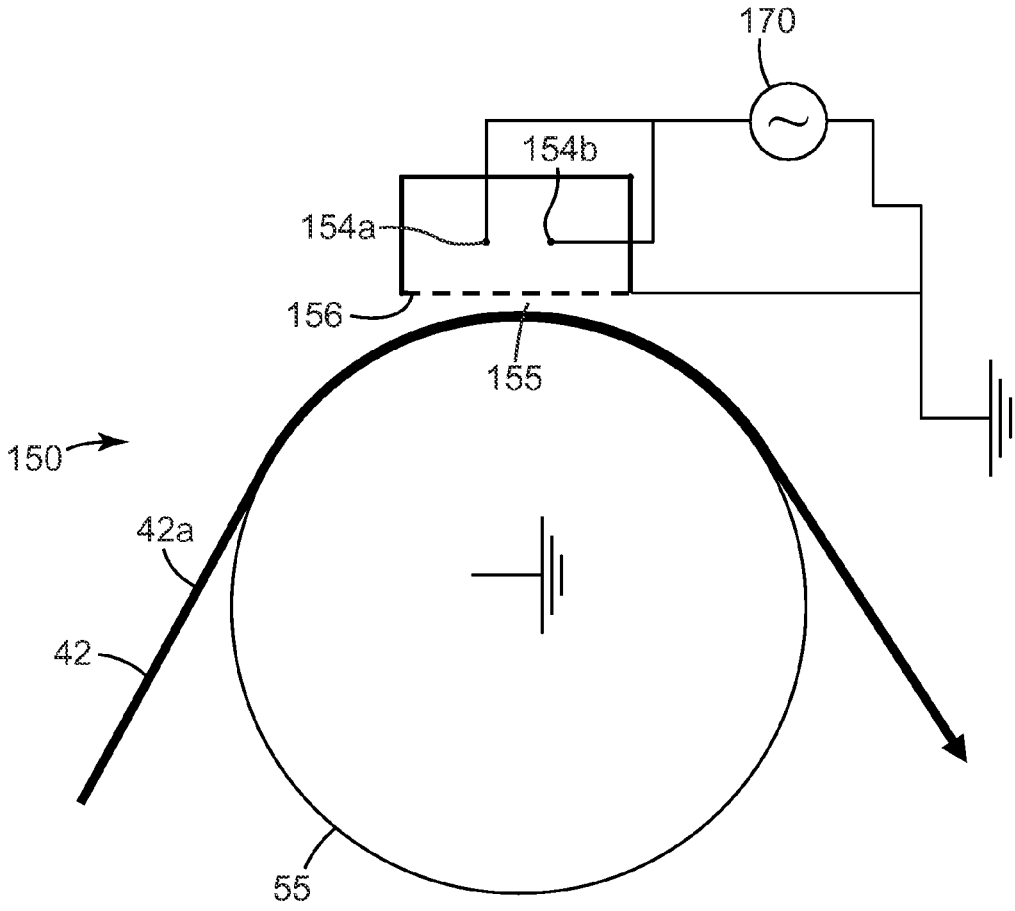
FIG. 10 is an enlarged view of a first embodiment of a bipolar neutralizer in accordance with this disclosure.

This test was done using a 0.004 inch thick web with an embedded conductive layer. The corona treater (i.e., corona treater 44 of FIG. 9) was not used. Line speed was 50 ft/min. Two bipolar neutralizers were used, positioned where neutralizers 50*a*, 50*c* in FIG. 9 are positioned; the particular neutralizers used in this trial are illustrated in FIG. 10 as neutralizer 150.

Each bipolar neutralizer 150 included a grounded screen 156 positioned approximately 0.035 inch (i.e., gap 155) above the top side 42*a* of web 42 while the web was wrapped on a grounded roller. Screen 156 was a thin sheet of stainless steel metal with 100 μm slits running at approximately 45 degrees to the down web direction. Two 0.003 inch wires 154*a*, 154*b* above the grounded screen were powered using a 7.5 kV, 5 mA, 60 Hz HVAC (i.e., high voltage AC) power supply 170 controlled with a variable transformer to keep wire voltage just below the arcing potential. When HVAC was applied to the wires, positive and negative corona ions from the vicinity of wires 154*a*, 154*b* were accelerated to screen 156 and a fraction of these passed through the slits and entered gap 155 between screen 156 and web surface 42*a*. Once in gap 155, the electric field due to the bipolar charge on the web pulled the ions in for neutralization of web side 42*a*.

Figure 11:
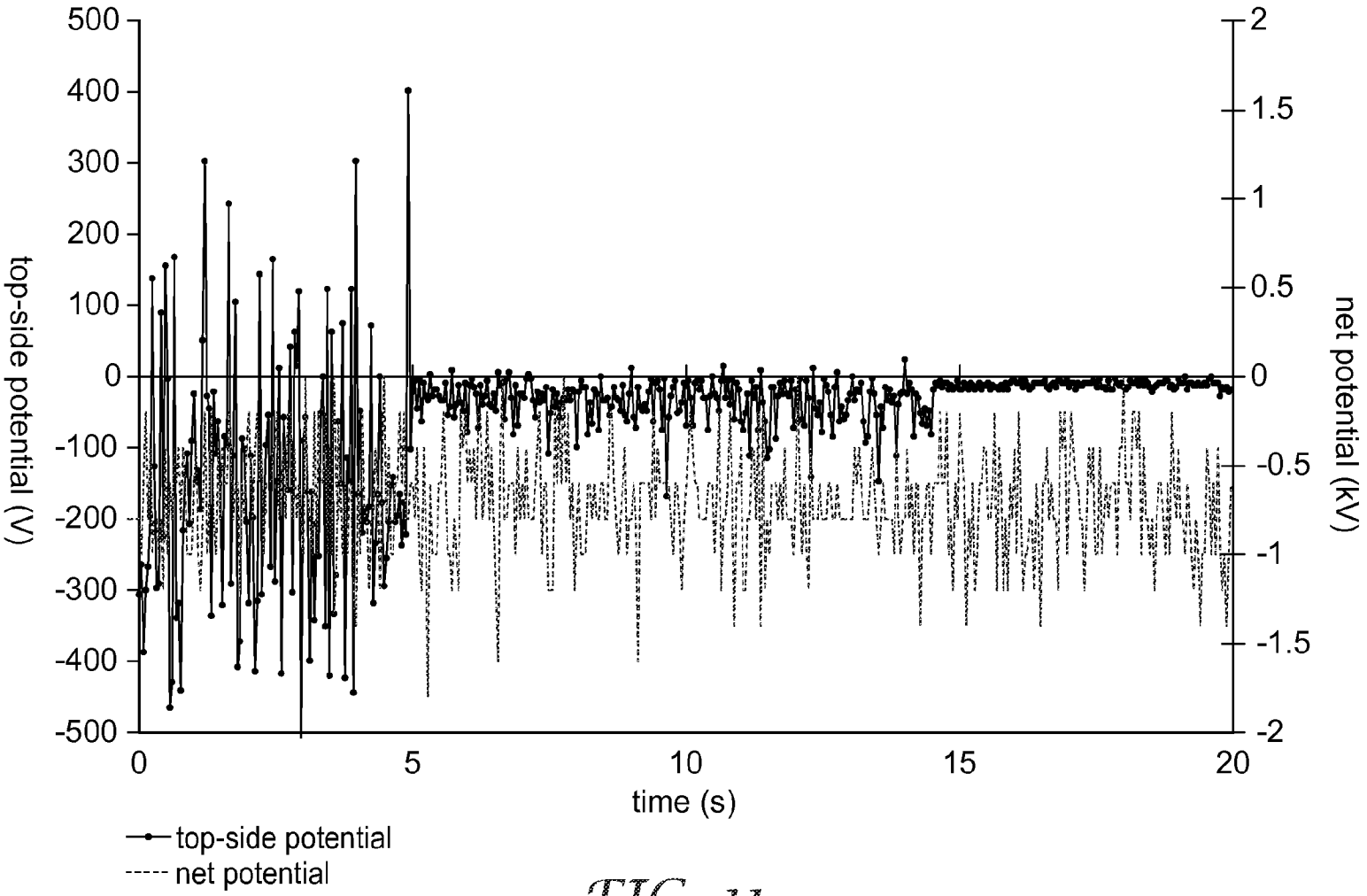
FIG. 11 is a graphical representation of the ability of the methods and apparatus of this disclosure to neutralize bipolar charge on a web with an embedded conductive layer; the data was collected on the line illustrated in FIG. 9 using the bipolar neutralizer illustrated in FIG. 10.

FIG. 11 shows the bipolar, or top-side, charge of the web with and without bipolar neutralization. Approximately 20 seconds into the run time=0 in FIG. 11), both bipolar neutralizers 150 were turned on. The effect of the second bipolar neutralizer was seen approximately 5 seconds later, and the combined effect of both bipolar neutralizers was seen approximately 15 seconds later (t=15 in FIG. 11). Using two bipolar neutralizers 150, the bipolar charge was reduced by at least two orders of magnitude. It was noted that the net potential in the freespan was initially fairly low and remained approximately the same throughout the entire run. Undesirable directionality of the web in the oven was eliminated and quality of the coating, in general, increased with the application of these bipolar neutralization devices.

Example 2

Figure 12:
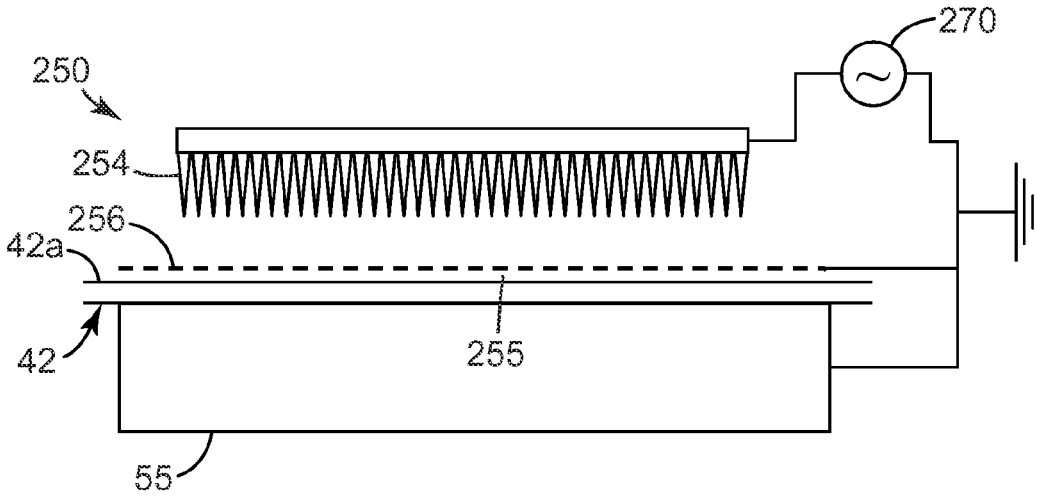
FIG. 12 is an enlarged view of a second embodiment of a bipolar neutralizer in accordance with this disclosure.

This test was done using approximately 0.005 inch thick optical grade dielectric web with no conductive layers. Corona treater 44 was used at significant power (to increase bipolar charge generation) and line speed was 50 ft/min. Two bipolar neutralizers were used, positioned where neutralizers 50*a*, 50*c* in FIG. 9 are positioned; the particular neutralizers used in this trial are illustrated in FIG. 12 as neutralizer 250. Each bipolar neutralizer 250 included a grounded screen 256 positioned approximately 0.035 inch (i.e., gap 255) above the top side 42*a* of web 42 while the web was wrapped on a grounded roller 55. Screen 256 consisted of thin sheet of conductive metal perforated with rows of approximately 0.025 inch diameter holes at a pitch of about 0.04 inch, running at about 87 degrees to the down web direction. A single thin saw-tooth blade 254 above grounded screen 256 was powered using a 7.5 kV, 5 mA, 60 Hz HVAC power supply 270 controlled with a variable transformer to keep blade voltage just below the arcing potential. When HVAC was applied to blade 254, positive and negative corona ions from the vicinity of the blade teeth were accelerated to screen 256 and a fraction of these passed through the perforations and entered gap 255 between screen 256 and web surface 42*a*. Once in gap 255, the electric field due to the bipolar charge on the web pulled the ions in for neutralization.

Figure 13:
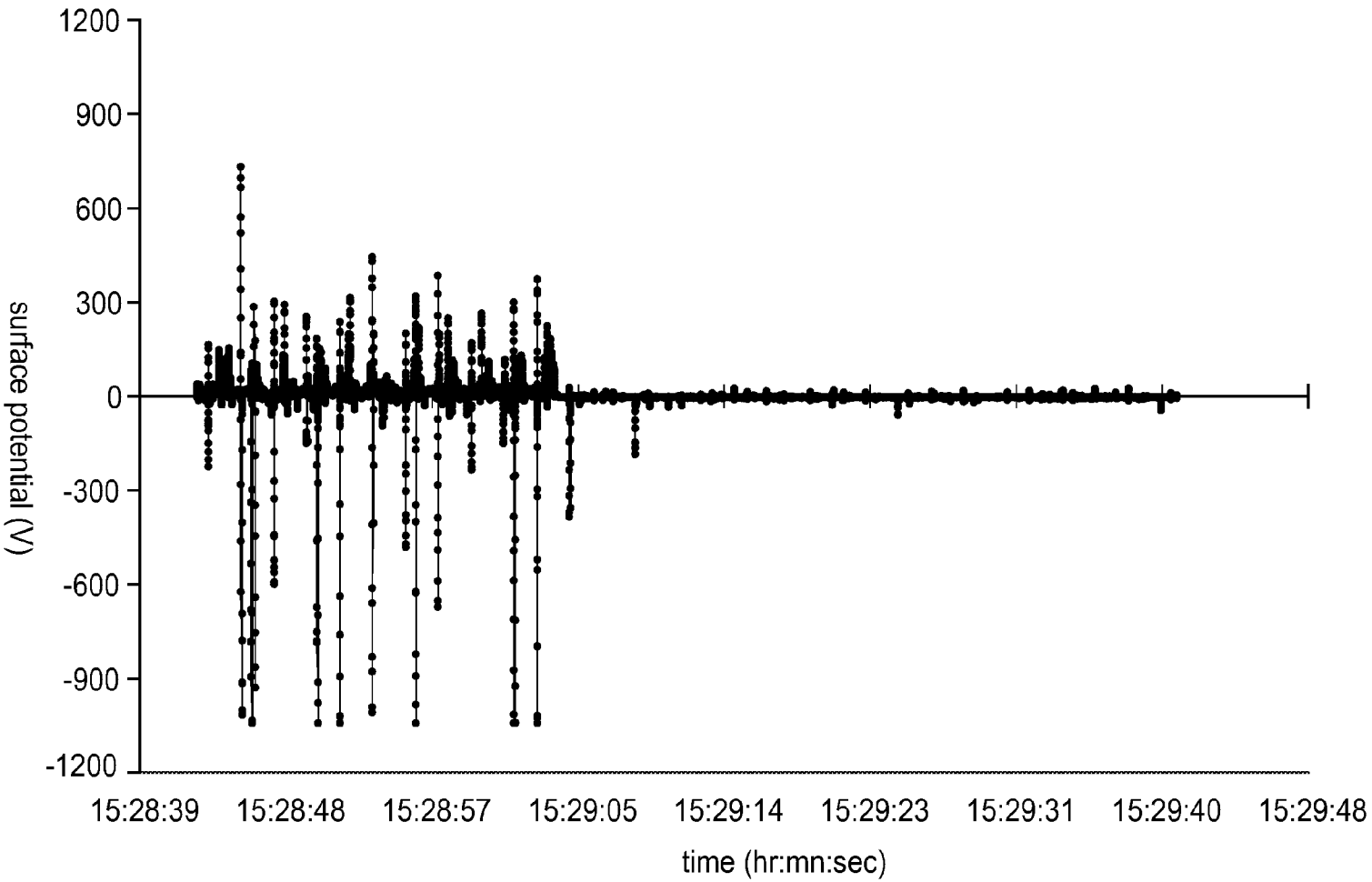
FIG. 13 is a graphical representation of the ability of the methods and apparatus of this disclosure to neutralize bipolar charge on a dielectric web; the data was collected on the line illustrated in FIG. 9 using the bipolar neutralizer illustrated in FIG. 12.

FIG. 13 shows the bipolar, or top-side, charge of the web with and without bipolar neutralization. Both bipolar neutralizers 250 were turned on, and the combined effect of both bipolar neutralizers was seen within 0.11 seconds. Using two bipolar neutralizers 250, the bipolar charge was reduced by at least two orders of magnitude. Undesirable directionality of the web in the oven was eliminated and quality of the coating in general increased with the application of these bipolar neutralization devices.

Example 3

Figure 14:
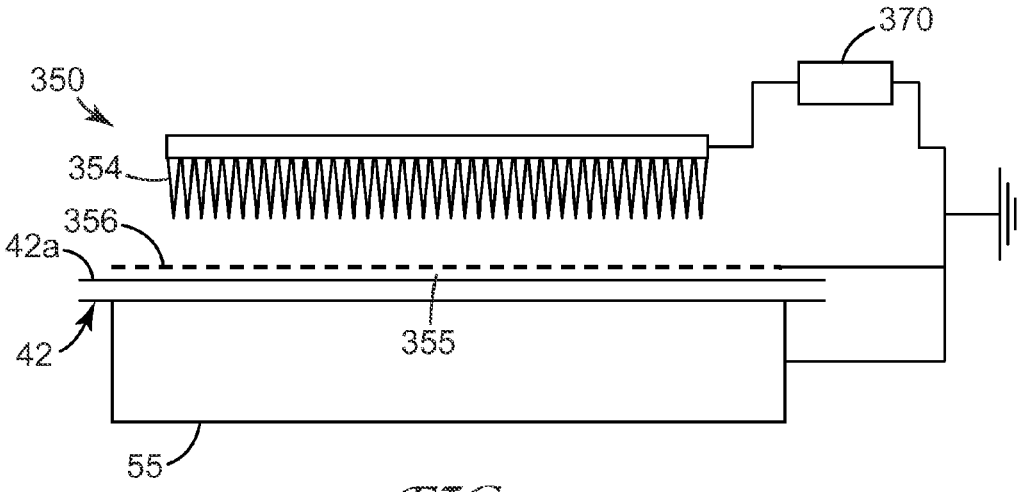
FIG. 14 is an enlarged view of a third embodiment of a bipolar neutralizer in accordance with this disclosure.

This test was done using approximately 0.005 inch thick optical grade dielectric web with no conductive layers. Corona treater 44 was used at significant power (to increase bipolar charge generation) and line speed was 100 ft/min. Two bipolar neutralizers were used, positioned where neutralizers 50*a*, 50*c* in FIG. 9 are positioned; the particular neutralizers used in this trial are illustrated in FIG. 14 as neutralizer 350.

Each bipolar neutralizer 350 included a grounded screen 356 positioned approximately 0.035 inch (i.e., gap 355) above the top side 42*a* of web 42 while the web was wrapped on a grounded roller 55. Screen 356 consisted of a thin sheet of conductive metal perforated with rows of approximately 0.025 inch diameter holes at a pitch of about 0.04 inch, running at about 87 degrees to the down web direction. A single thin saw-tooth blade 354 above the grounded screen 356 was powered with an HVDC (i.e., high voltage DC) power supply 370. One bipolar neutralizer 350 was powered using a Glassman +10 kV, 30 mA HVDC power supply and the other bipolar neutralizer 350 was powered using a Glassman −10 kV, 30 mA HVDC power supply. The Glassman power supplies were operated in current limit mode with the current from each HVDC limited to about 1.2 mA per foot of blade 354. When HVDC was applied to blade 354, positive (for +HVDC) or negative (for HVDC) corona ions from the vicinity of the blade teeth were accelerated to screen 356 and a fraction of these passed through the perforations and entered gap 355 between the screen 356 and web surface 42*a*. Once in gap 355, the electric field due to the bipolar charge on the web pulled the ions in for neutralization.

Figure 15:
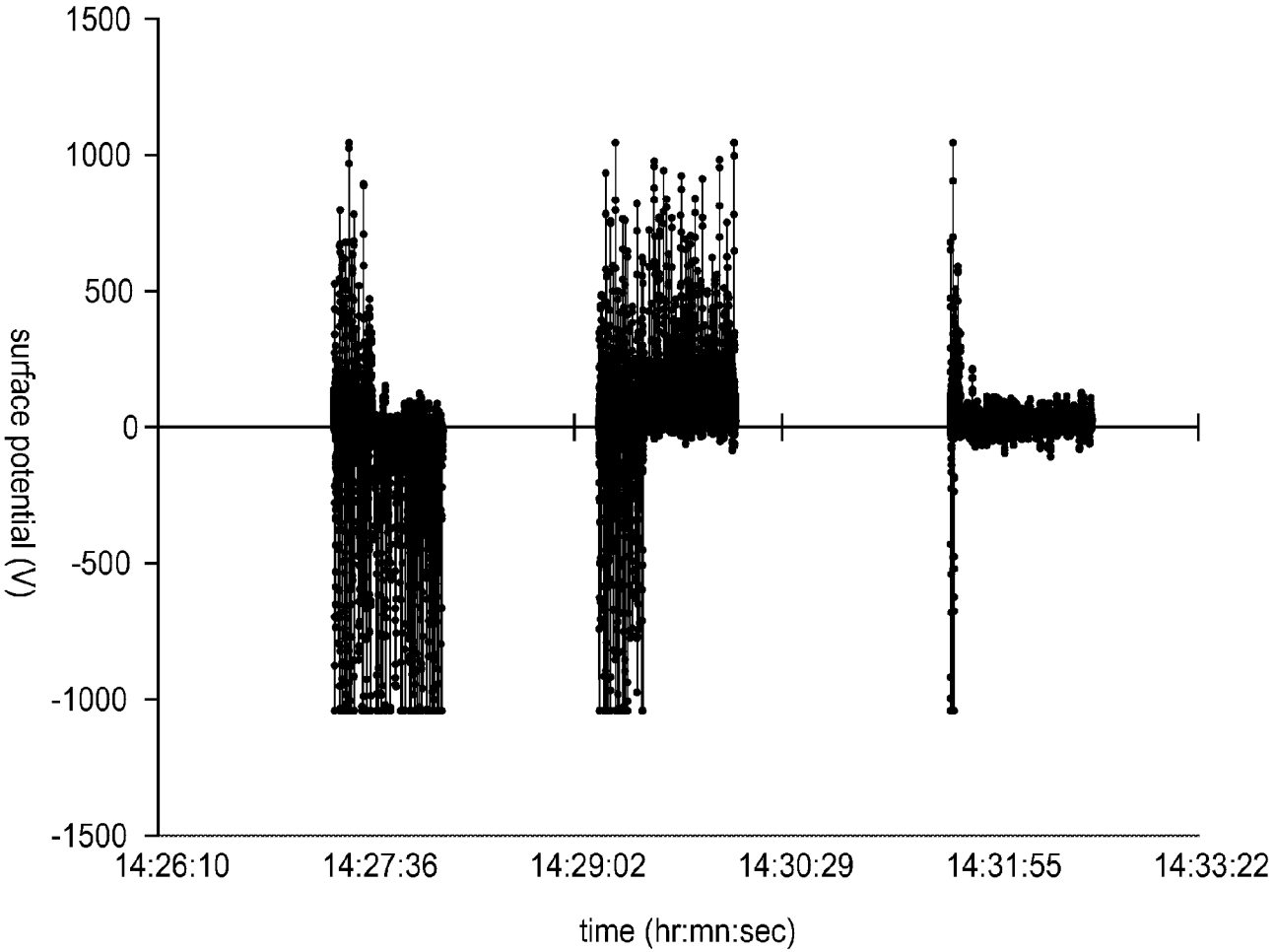
FIG. 15 is a graphical representation of the ability of the methods and apparatus of this disclosure to neutralize bipolar charge on a dielectric web. The data was collected on the line illustrated in FIG. 9. The data on the left shows the results using one of the bipolar neutralizers illustrated in FIG. 14 with negative HVDC. The data on the left shows the results using one of the bipolar neutralizers illustrated in FIG. 14 with positive HVDC. The data on the right shows the results using two of the bipolar neutralizer illustrated in FIG. 12 (one positive HVDC, one negative HVDC).

FIG. 15 shows the bipolar, or top-side, charge of the web with and without bipolar neutralization for the cases of using one +HVDC bipolar neutralizer 350, using one −HVDC bipolar neutralizer 350, and using both +HVDC and HVDC bipolar neutralizers 350. The first set of data in FIG. 15 (at time 0) shows the top-side potential initially with no bipolar neutralization and then the effect of turning on a single bipolar neutralizer 350 powered with −HVDC. The single −HVDC bipolar neutralizer 350 significantly reduced the positive portions of the initial bipolar charge, while leaving the negative portions unchanged. The cutoff of the data at about −1000V was due to the data acquisition system being able to only collect data in [−1000, 1000] range.

The second set of data in FIG. 15 (at time of approximately 2:15 seconds) shows the top-side potential initially with no bipolar neutralization and then the effect of turning on a single bipolar neutralizer 350 powered with +HVDC. The single +HVDC bipolar neutralizer 350 significantly reduced the negative portions of the initial bipolar charge, while leaving the positive portions unchanged.

The third set of data in FIG. 15 (at time of approximately 4 seconds) shows the top-side potential initially with no bipolar neutralization and then the effect of turning on both bipolar neutralizers 350, one powered with +HVDC, the other with −HVDC. Both positive and negative portions of the initial bipolar charge distribution were reduced by more than two orders of magnitude.

Figure 16:
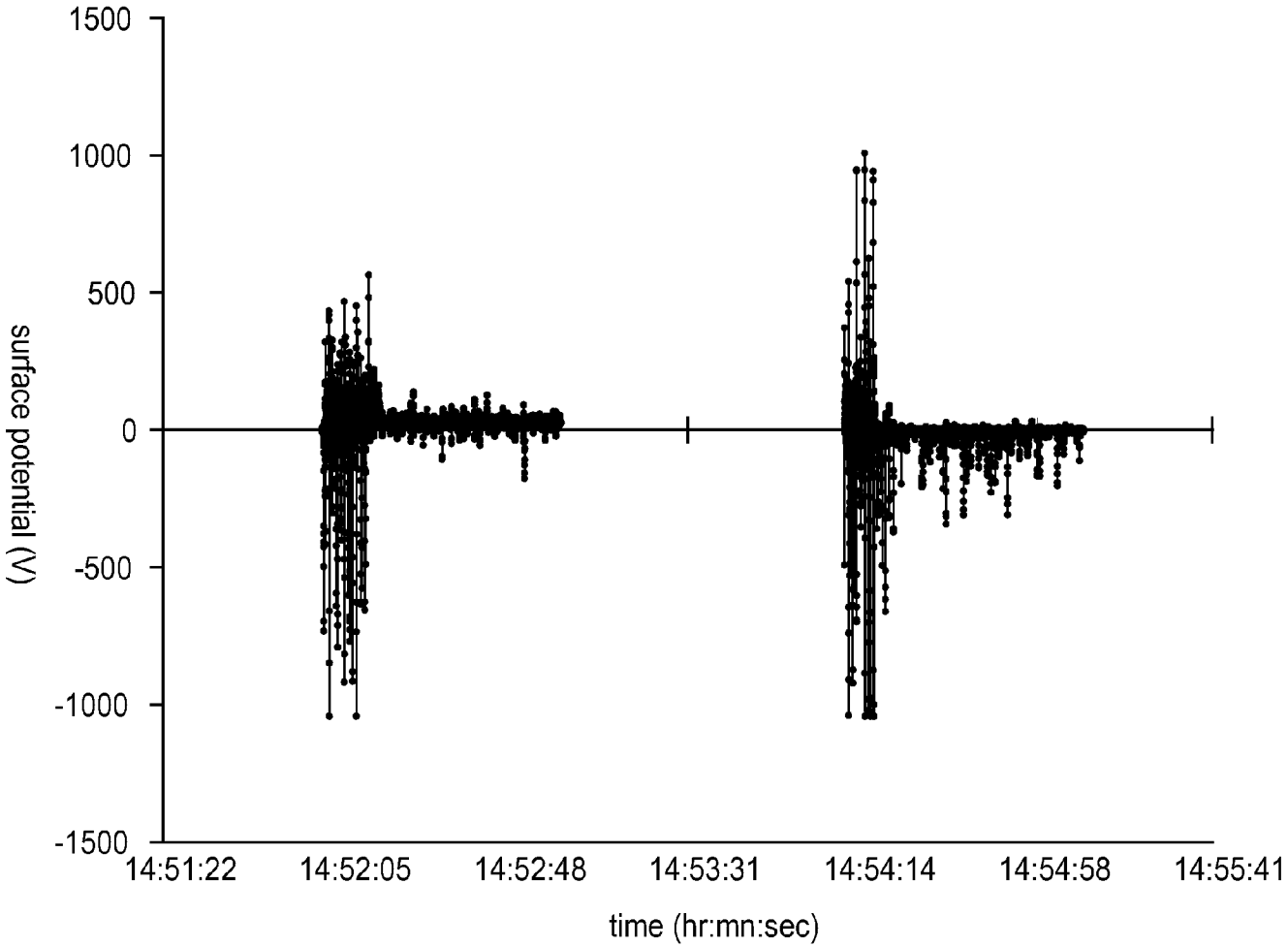
FIG. 16 is a graphical representation of the ability of the methods and apparatus of this disclosure to neutralize bipolar charge on a dielectric web. The data was collected on the line illustrated in FIG. 9. The data on the left shows the results using two of the bipolar neutralizers illustrated in FIG. 14 (one positive HVDC, one negative HVDC). The data on the right shows the results using two of the bipolar neutralizer illustrated in FIG. 12 (HVAC).

FIG. 16 compares the performance of HVDC (Example 3) to that of HVAC (Example 2). The first set of data (at time 0) shows the top-side charge initially with no bipolar neutralization, then with two HVDC bipolar neutralizers 350 operating (one −HVDC, one +HVDC). The second set of data (at time of about 2 seconds) shows the top-side charge initially with no bipolar neutralization, then with two HVAC bipolar neutralizers 250 operating.

For this example, two HVDC bipolar neutralizers 350 performed better than two HVAC bipolar neutralizers 250. The main reason in this was that the two HVDC bipolar neutralizers 350 operated at constant corona current from blades 354 (set at 1.2 mA/ft). Running the HVDC power supply 370 in current limit mode allowed the blades 354 to take on whatever voltage was needed to achieve a corona current of 1.2 mA/ft. For the −HVDC power supply 370 this corona current was realized at a blade voltage lower than for +HVDC bipolar neutralizer 350. The HVAC bipolar neutralizers 250, on the other hand, alternate equally between positive and negative voltages, and the amount of negative ion generation (during the negative half cycle) is greater than the amount of positive ion generation (during the positive half cycle).

It is noted that with the use of HVDC-biasing of the HVAC signal, that +1 kV DC biasing of a 7.5 kV, 5 mA, 60 Hz HVAC signal generates roughly equal amounts of positive and negative neutralizing currents to a test plate using bipolar neutralizer 250 illustrated in FIG. 12.

It is also noted that in some embodiments, rather than using two or more neutralizers, it may be desirable to increase the power (e.g., current) in one neutralizer and avoid multiple neutralizers on the same side of the web.

In the above examples, the corona-generated ions for bipolar neutralization were done on the top side 42*a* of web 42. However, once the grounded conductive element (e.g., screen 156, 256, 356 in the above examples) was placed in close proximity to one side of the web (while the web was wrapped on grounded roller 55), any method could be used to insert ions into gap 155, 255, 355.

Example 4

A series of test were done on a laboratory set-up similar to process 40 of FIG. 9. The trial was performed on high performance window film. From previous web handling processes with this film web, it has been known that exposure to a corona treater is responsible for generating static on the web which then leads to touchdown in the subsequent gap dryer. "Touchdown" is the contact of the web to a side wall of the dryer, due to the field formed by a single-side charge on the web. It is well known that a coating (e.g., adhesive coating) when wet, is grounded and neutralizes the side having the coating thereon, thus leaving the other side charged.

Using the set-up of FIG. 9, various runs were conducted to determine suitable process configurations to inhibit touchdown of the web.

In the following table, "CMS" represents "charge modifying device", which included grounded tensioner rolls 55 contacting the back side (e.g., side 42*b*) of the web and a grounded element (e.g., screen 56) proximate the front side (e.g., side 42*a*).

| Run | line speed (ft/min) | corona power (w) | CMS | coat-ing | touch-down | comments |
|---|---|---|---|---|---|---|
| 0 | 20 | 0 | N | N | N | |
| 1 | 20 | 0 | N | Y | N | no data collected |
| 2 | 20 | 300 | N | N | N | no data collected |
| 3 | 20 | 300 | N | Y | Y | |
| 4 | 20 | 0 | N | Y | N | |
| 5 | 20 | 300 | N | N | N | |
| 6 | 20 | 300 | Y | N | N | No nuclear bar after second CMS |
| 7 | 20 | 300 | N | N | N | |
| 8 | 20 | 0 | N | N | N | |
| 9 | 20 | 300 | N | Y | Y | |
| 10 | 20 | 300 | Y | Y | N | Nuclear bar held manually in place after second CMS |
| 11 | 20 | 300 | N | Y | Y | |
| 12 | 40 | 600 | N | Y | Y | |
| 13 | 40 | 600 | Y | Y | N | No nuclear bar after second CMS |
| 14 | 40 | 600 | Y | Y | N | Nuclear bar held manually in place after second CMS |
| 15 | 20 | 300 | N/A | Y | Y | Both CMS replaced with nuclear bars |

Touchdown occurred only during coating and when the corona treater was on. Use of at least one charge modification system eliminated touchdown in all cases. This can be seen by comparing Run 9 to Runs 10 and 11, and by comparing Run 12 to Runs 13 and 14. Run 15 used conventional nuclear bars mounted in place of the grounded screen and corona screen; the nuclear bars were not successful at preventing touchdown.

Figure 17:
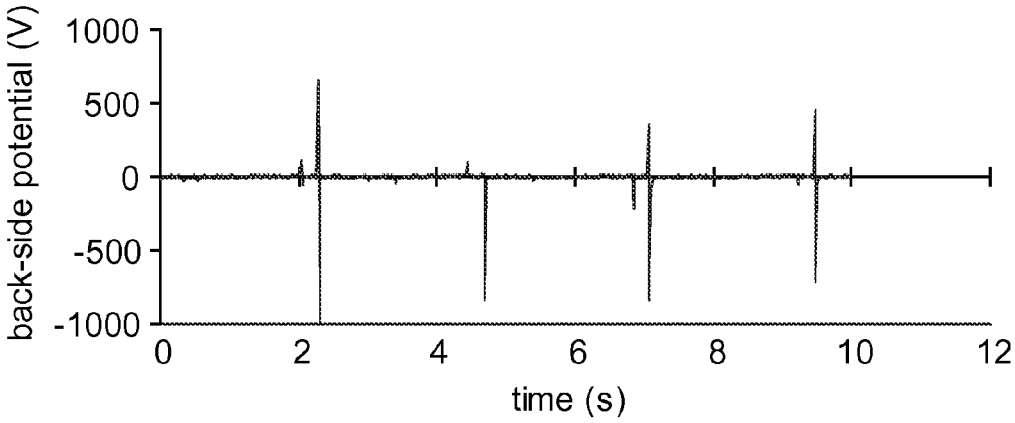
FIG. 17 is a graphical representation of the backside potential (in volts) on a charged web as it contacts a surface (referred to as "touchdown").
Figure 18:
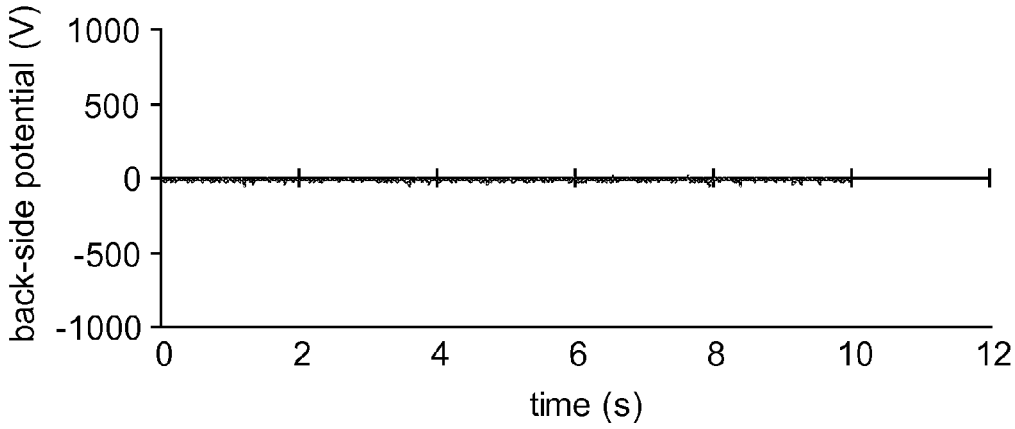
FIG. 18 is a graphical representation of the backside potential (in volts) of a web neutralized with a charge modification system of the present invention.

FIGS. 17 and 18 illustrate the elimination of single-side charge by neutralization by the charge modification system used in the tests. FIG. 17 shows the back-side potential without bipolar net neutralization according the present invention. FIG. 18 shows the back-side potential with bipolar net neutralization according the present invention. It is seen that a web neutralized with the apparatus and method of the present invention decreases spikes in electrostatic charge that cause web touchdown.

The above specification and examples are believed to provide a complete description of the manufacture and use of particular embodiments of the invention. Because many embodiments of the invention can be made without departing from the spirit and scope of the invention, the true scope and spirit of the invention reside in the broad meaning of the claims hereinafter appended.

What is claimed is:

1. An apparatus for net neutralizing a surface comprising:

(a) a grounded element positionable at least in close proximity to a first side surface; and (b) an ion source and a second grounded element positionable in close proximity to a second side surface, the second grounded element positioned between the ion source and the second side surface; wherein the second grounded element is a foraminous element, wherein the foraminous element comprises an opening and wherein the foraminous element has at least one of the following:

(i) a ratio of open area to total area of at least 0.3;

(ii) wherein the smallest dimension of the opening is no greater than 0.6 mm; and (iii) wherein the distance between the second side surface and the second grounded element is greater than the smallest dimension of the opening of the foraminous element.

2. The apparatus of claim 1, wherein the grounded element is positionable to contact the first side surface.

3. The apparatus of claim 1, wherein the ion source is at least one of: (a) a conductive element connected to a power source and (b) an ion gun, an ion blower, alpha radiation source, or an X-ray source.

4. The apparatus of claim 1 further comprising one or more nuclear bars.

5. The apparatus of claim 1, wherein the smallest dimension of the opening of the foraminous element is no smaller than 0.1 mm.

6. A method for neutralizing a surface comprising:

(a) providing a grounded element at least in close proximity to a first side surface; and (b) providing an ion source and a second grounded element in close proximity to a second side surface, the second grounded element positioned between the ion source and the second side surface wherein the second grounded element is a foraminous element, wherein the foraminous element comprises an opening and wherein the foraminous element has at least one of the following:

(i) a ratio of open area to total area of at least 0.3;

(ii) wherein the smallest dimension of the opening is no greater than 0.6 mm; and (iii) wherein the distance between the second side surface and the second grounded element is greater than the smallest dimension of the opening of the foraminous element.

7. The method of claim 6, wherein the surface is the surface of a dielectric web.

8. The method of claim 6, wherein the grounded element contacts the first side surface.

9. The method of claim 6, wherein the ion source is at least one of:

(a) a conductive element; and (b) an ion gun, an ion blower, alpha radiation source, or an X-ray source.

10. The method of claim 6 further comprising providing one or more nuclear bars for net neutralizing the surface.

11. The method of claim 6, wherein the smallest dimension of the opening of the foraminous element is no smaller than 0.1 mm.

12. A web handling apparatus comprising:

(a) a web source providing the web;

(b) a corona treater positioned to act upon the web;

(c) a bipolar neutralization apparatus comprising:

(i) a grounded roller positioned against a first side of the web; and (ii) an ion source and a second grounded element positioned in close proximity to a second side of the web, the second grounded element positioned between the ion source and the second side wherein the second grounded element is a foraminous element, wherein the foraminous element comprises an opening and wherein the foraminous element has at least one of the following:

(a) a ratio of open area to total area of at least 0.3;

(b) wherein the smallest dimension of the opening is no greater than 0.6 mm; and (c) wherein the distance between the second side surface and the second grounded element is greater than the smallest dimension of the opening of the foraminous element.

13. The apparatus of claim 12, wherein the ion source is at least one of (a) a conductive element; and (b) an ion gun, an ion blower, alpha radiation source, or an X-ray source.

14. The apparatus of claim 12, the bipolar neutralization apparatus further comprising one or more nuclear bars.

15. The apparatus of claim 12, further comprising a gap dryer downweb of the bipolar neutralization apparatus.

16. The apparatus of claim 12, wherein the smallest dimension of the opening of the foraminous element is no smaller than 0.1 mm.

17. A web handling apparatus comprising:

(a) a web source providing the web;

(b) a bipolar neutralization apparatus comprising:

(i) a grounded roller positioned against a first side of the web; and (ii) an ion source and a second grounded element positioned in close proximity to a second side of the web, the second grounded element positioned between the ion source and the second side;

(c) a coating station downweb of the bipolar neutralization apparatus; and (d) a gap dryer downweb of the coating station wherein the second grounded element is a foraminous element, wherein the foraminous element comprises an opening and wherein the foraminous element has at least one of the following:

(i) a ratio of open area to total area of at least 0.3;

(ii) wherein the smallest dimension of the opening is no greater than 0.6 mm; and (iii) wherein the distance between the second side surface and the second grounded element is greater than the smallest dimension of the opening of the foraminous element.

18. The apparatus of claim 17, wherein the ion source is at least one of: (a) a conductive element; and (b) an ion gun, an ion blower, alpha radiation source, or an X-ray source.

19. The apparatus of claim 17, further comprising a corona treater upweb of the bipolar neutralization apparatus.

20. The apparatus of claim 17, wherein the smallest dimension of the opening of the foraminous element is no smaller than 0.1 mm.

* * * * *

UNITED STATES PATENT AND TRADEMARK OFFICE

CERTIFICATE OF CORRECTION

PATENT NO. : 8,570,703 B2
APPLICATION NO. : 12/602692
DATED : October 29, 2013
INVENTOR(S) : Richard M Jendrejack et al.

It is certified that error appears in the above-identified patent and that said Letters Patent is hereby corrected as shown below:

In the Specification

Column 7
Line 21: Delete "$q_s$" and insert -- $-q_s$ --, therefor.
Line 40: Delete "R(x)" and insert -- –R(x) --, therefor.
Line 47: Delete "$q_s$," and insert -- $-q_s$, --, therefor.

Column 13
Line 35: Delete "time=0" and insert -- (time=0 --, therefor.

Column 13-14
Line 57-67 (Col. 13) 1-6 (Col. 14): Delete "Each bipolar……for neutralization."
and insert the same on Col. 13, Line 57 as a new paragraph.

Column 14
Line 44: Delete "(for HVDC)" and insert -- (for –HVDC) --, therefor.
Line 53: Delete "and HVDC" and insert -- and –HVDC --, therefor.

Signed and Sealed this
Third Day of June, 2014

Michelle K. Lee

Michelle K. Lee
*Deputy Director of the United States Patent and Trademark Office*